United States Patent [19]

Carter et al.

[11] Patent Number: 4,711,740

[45] Date of Patent: Dec. 8, 1987

[54] DETERGENT COMPOSITIONS

[75] Inventors: Malcolm N. A. Carter; Reginald V. Scowen, both of Merseyside, England

[73] Assignee: Lever Brothers Company, New York, N.Y.

[21] Appl. No.: 870,298

[22] Filed: May 23, 1986

Related U.S. Application Data

[63] Continuation of Ser. No. 599,376, Apr. 12, 1984, abandoned.

[30] Foreign Application Priority Data

Apr. 22, 1983 [GB] United Kingdom ..... 8311002

[51] Int. Cl.[4] ..... C11D 3/37

[52] U.S. Cl. ..... 252/174.24; 252/174.14; 252/174.25; 252/DIG. 2

[58] Field of Search ..... 252/174.24, 174.25, 252/174.14, DIG. 2

[56] References Cited

U.S. PATENT DOCUMENTS

| | | | |
|---|---|---|---|
| 4,022,702 | 5/1977 | Curtis | 252/131 |
| 4,076,653 | 2/1978 | Davies et al. | 252/532 |
| 4,203,859 | 5/1980 | Kirn et al. | 252/174.23 |
| 4,407,722 | 10/1983 | Davies et al. | 252/91 |
| 4,473,485 | 9/1984 | Greene | 252/174.24 |

FOREIGN PATENT DOCUMENTS

| | | |
|---|---|---|
| 7216798 | 6/1973 | Netherlands . |
| 0935733 | 9/1963 | United Kingdom . |
| 1361642 | 7/1974 | United Kingdom . |
| 1379024 | 1/1975 | United Kingdom . |
| 1437950 | 6/1976 | United Kingdom . |
| 2023121B | 12/1979 | United Kingdom . |

OTHER PUBLICATIONS

U.S. patent application Ser. No. 336,810 (Hollingsworth) filed 01/04/82, Equivalent to British Patent No. 2,109,398, (Unilever).

*Primary Examiner*—Paul Lieberman
*Assistant Examiner*—Hoa Van Le
*Attorney, Agent, or Firm*—Gerard J. McGowan, Jr.; James J. Farrell

[57] ABSTRACT

A detergent composition containing a detergent active, sodium carbonate and calcite also contains a copolymer to reduce deposition of insoluble material on fabrics. The copolymer is derived from a carboxylic monomer and a non-carboxylic monomer, with the non-carboxylic monomer being in excess. A 3:1 copolymer of sulphonated styrene and maleic anhydride is exemplified.

7 Claims, No Drawings

DETERGENT COMPOSITIONS

This is a continuation of application Ser. No. 599,376 filed Apr. 12, 1984, now abandoned.

FIELD OF THE INVENTION

This invention relates to detergent compositions, particularly but not exclusively to detergent compositions for washing fabrics.

BACKGROUND ART

Detergent compositions for washing fabrics conventionally contain a detergent active material and a builder material, the latter being added in order, inter alia, to reduce the level of free calcium ions in the wash liquor. While phosphate salts, particularly sodium tripolyphosphate, are often used as builder materials there is an increasing desire to use alternative materials in order to avoid any environmental problems which might arise due to the discharge of phosphate containing waste liquors into rivers and lakes. While a number of alternative builder materials have been suggested, water-soluble carbonates such as sodium carbonate are particularly attractive from the point of view of cost. However, the use of sodium carbonate as a builder material has certain disadvantages, amongst which are the tendency of the precipitated calcium carbonate to become deposited on the fabrics and the sensitivity of the calcium ion/carbonate reaction to poisoning by materials which may well be present, even unintentionally, in the wash liquors resulting in a final free calcium ion concentration which is not as low as is desirable to achieve good detergency.

While it might be supposed that the problem of deposition on fabrics could be overcome by the use of a colloid stabiliser it has been found that such materials are also carbonate precipitation crystal growth poisons and their use leads to a higher final free calcium ion concentration than is desirable.

It is known, for example from GB No. 1 437 950 (UNILEVER) to include high surface area insoluble carbonate material such as calcite in detergent compositions which include, for example, sodium carbonate as a builder, to act both as a seed crystal for the precipitating calcium carbonate and as an adsorbent for any crystal growth poisons which may be present. The use of a seed crystal ensures that the precipitated calcium grows to a crystal size which is sufficient that it will not be deposited on the fabrics. However, to be effective, calcite itself must be maintained in a dispersed state. In practice this has been difficult to achieve without poisoning the seed activity of crystalline forms of calcium carbonate.

DISCLOSURE OF THE INVENTION

We have now surprisingly found a class of polymeric materials which will act as colloid stabilisers for the precipitated calcium carbonate in the presence of added calcite substantially without poisoning calcium carbonate crystal growth, thereby leading to low levels of deposition on fabrics while maintaining acceptable detergency.

Thus, according to the invention, there is provided a detergent composition containing at least the following ingredients:

(i) a detergent active material;

(ii) a water-soluble carbonate material; and (iii) a water-insoluble carbonate material, characterised in that it further contains a copolymer formed from a first ethylenically unsaturated monomer which includes at least one carboxylic acid group and a second ethylenically unsaturated monomer which is free of carboxylic acid groups, the weight ratio of the second monomer to the first monomer being greater than 1:1 and less than 6:1, the copolymer having a molecular weight of between 1,000 and 500,000.

BEST METHOD OF PERFORMING THE INVENTION

An essential component of the composition according to the invention is a detergent active material. This material may be selected from anionic, nonionic, amphoteric and zwitterionic detergent active compounds and mixtures thereof, particularly such compounds which do not form during use at normal product concentration in hard water excessively water insoluble calcium salts; this ensures that the detergent active compound is not completely precipitated as its calcium salt instead of calcium carbonate being precipitated. Some degree of precipitation of the detergent active compound or mixture of compounds in the form of the calcium salts may be tolerated, provided that after allowing for the subsequent redissolution of any of the calcium salt during the washing process, the amount of any more permanent precipitate is minor and an effective amount of detergent active compound is left in solution.

Many suitable synthetic detergent active compounds are commercially available and they are fully described in the literature, for example in "Surface Active Agents and Detergents" Volumes 1 and 2, by Schwartz, Perry and Berch.

The preferred detergent active compounds are fully described in GB No. 1 437 950 referred to above.

The effective amount of the detergent active compounds or compounds used in the compositions of the present invention is generally in the range from 5 to 40% by weight, preferably not more than 30% by weight of the composition.

The water-soluble carbonate material used is preferably sodium or potassium carbonate or a mixture thereof, for reasons of cost and efficiency. The carbonate salt is preferably fully neutralised but it may be partially neutralised, for example a sesquicarbonate may be used in partial replacement of the normal carbonate salt; the partial salts tend to be less alkaline and therefore less efficient. The amount of water-soluble carbonate material in the detergent composition can be varied widely, but the amount should be at least 5% by weight, such as from 10% to 40%, preferably 10% to 30% by weight, though an amount of up to 75% could possibly be used if desired in special products. The amount of the water-soluble carbonate material is determined on an anhydrous basis, though the salts may be hydrated either before or when incorporated into the detergent composition. It should be mentioned that within the preferred range the higher levels tend to be required under conditions of use at low product concentrations, as is commonly the practice in North America, and the converse applies under conditions of use at higher product concentrations, as tends to occur in Europe. It should be noted that it may also be desirable to limit the carbonate content to a lower level within the range mentioned, so as to decrease the risk of internal damage following any accidental ingestion, for example by children.

The first monomer preferably has the general formula

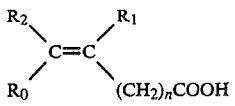

(I)

wherein $R_0$ and $R_1$ are each selected from hydrogen, hydroxyl, $C_1$–$C_4$ substituted or unsubstituted alkyl, alkenyl or alkoxy or an acetoxy group and $R_2$ is selected from the same substituents as $R_1$ or is a carboxylic acid group and n is an integer from 0 to 4. In the above general formula, the groups $R_0$ and $R_2$ may be interchanged. Thus where two such isomers exist, both cis- and trans-isomers are included. When $R_2$ is a carboxylic acid group, the polymer may be in the form of its corresponding anhydride. Suitable examples of the first monomer include acrylic acid, methacrylic acid, α-hydroxyacrylic acid, itaconic acid, maleic acid and maleic anhydride.

Preferably, the second monomer has the general formula:

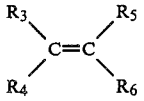

(II)

wherein $R_3$, $R_4$, $R_5$ and $R_6$, which may be the same or different, are selected from hydrogen, halide, hydroxyl, $C_1$–$C_4$ alkyl, alkenyl or alkoxy, acetoxy, acetyl, amide, alkylamide, nitrile, amino-, an aromatic hydrocarbon group and sulphonated derivations of any of the foregoing. Examples include ethylene, propylene, acrylamide, acrylonitrile, styrene, α-methyl styrene, methyl vinyl ketone, sulphonated styrene, vinyl acetate and 2-acrylamido-2-methyl propane sulphonic acid.

Within the scope of the present invention, but less preferred are copolymers derived from the second monomer of general formula (II) where one or more of $R_3$, $R_4$, $R_5$ and $R_6$ while not being carboxylic acid groups as such are derived therefrom, and have the general formula

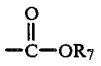

where $R_7$ is a substituted or unsubstituted hydrocarbon group. An example of such a second monomer is 2-hydroxy ethyl acrylate.

The weight ratio of the second monomer to the first monomer is preferably from 1.5:1 to 3:1.

The acid groups in the copolymer, ie the carboxylic acid groups and any other acid groups such as sulphonic acid groups, may be present in their true acid state or in salt form, in particular in the form of a salt with an alkali metal such as sodium. The copolymer may contain further carboxylic or non-carboxylic monomers, provided that the weight ratio of carboxylic monomers to non-carboxylic monomers falls within the ratios given above.

The copolymer used should have a molecular weight (measured on a weight average basis) of between 1,000 and 500,000 preferably at least 2,000 such as between 5,000 and 100,000. The copolymer should preferably be water-soluble.

The copolymers suitable for use in the present invention are known materials. GB No. 2 023 121 (DEARBORN) discloses the use of a copolymer of styrene sulphonic acid and maleic anhydride, with the molecular weight of about 4,000 to inhibit the formation of scale in industrial boilers. GB No. 1 361 642 (HULS) discloses detergent compositions containing relatively high levels of sulphonated carboxylic polymers with molecular weights below 3,000 as builders.

The amount of copolymer used in the compositions of the present invention should preferably be from 0.1% to 10% by weight, more preferably between 0.2% and 5%.

The water-insoluble carbonate material is preferably calcium carbonate. The insoluble carbonate material, when used, should be finely divided, and should have a surface area of at least 5 $m^2/g$, and preferably at least 15 $m^2/g$. The particularly preferred material has surface area from 30–100 $m^2/g$. Insoluble carbonate material with surface areas in excess of 100 $m^2/g$ may be used, up to say 150 $m^2/g$, if such materials are economically available.

The lower surface area materials are satisfactory when added to act as a seed crystal to reduce deposition on fabrics. The higher surface area material is particularly desirable when added to act as an adsorber for crystal growth poisons and as a seed crystal to achieve both adequate control of free calcium and deposition on fabrics.

Any crystalline form of calcium carbonate may be used or a mixture thereof, but calcite is preferred as aragonite and vaterite are less readily available commercially, and it appears that calcite is a little less soluble than aragonite or vaterite at most usual wash temperatures. When any aragonite or vaterite are used it is generally in admixture with calcite.

The selected level of insoluble carbonate material depends on the specific surface area and on the purpose for which it is added, as described above.

The amount of insoluble carbonate material used in the compositions should be from 5% to 60%, more preferably from 5% to 30%.

In addition to the water-insoluble carbonate material and the water-soluble carbonate material it is possible to include minor amounts of other detergency builders, provided that the total amount of the detergency builders does not exceed 85% by weight, so as to leave room in the detergent composition for other essential ingredients. One such detergency building ingredient is an alkali metal silicate, particularly sodium neutral, alkaline, meta- or orthosilicate. A low level of silicate, for example 5–10% by weight, is usually advantageous in decreasing the corrosion of metal parts in fabric washing machines, and it may give processing benefits. If higher levels of silicate are used up to a practical maximum of 30%, for example from 10% to 20% by weight, there can be a more noticeable improvement in detergency, which may permit some decrease in the water-soluble carbonate material content. This effect appears to be particularly beneficial when the compositions are used in water with appreciable levels of magnesium hardness. The amount of silicate can also be used to some extent to control the pH of the composition, which is generally within the range of 9–11, preferably 10–11 for an aqueous solution of the composition at the recommended concentration. It should be noted that a higher pH (i.e. over pH 10.5) tends to be more efficient as regards detergency, but it may be less desirable for domestic safety. Sodium silicate is commonly supplied in concentrated aqueous solution, but the amounts are calculated on an anhydrous basis.

Other detergency builders can be present, for example, other so-called precipitant builders which form insoluble calcium salts, such as the alkali metal soaps or salts of long-chain alpha-sulphonated monocarboxylic acids and alkali metal salts of alkyl and alkenyl succinic and malonic acids, and analogous compounds, some of which can have a desirable fabric softening effect, some sequestrant builders, such as sodium citrate, sodium tripolyphosphate, sodium pyrophosphate, nitrilo triacetic acid and its salts and polyacetalcarboxylates (see U.S. Pat. Nos. 4,144,125 and 4,146,495) or ion exchange materials such as crystalline or amorphous aluminosilicates. Where salts are specified as additional builders, it is to be understood that the corresponding acids may also be used where available. It should be noted, however, that some detergency builders, especially certain sequestrants such as polyphosphates and certain polymeric poly- carboxylate builders, can have a marked detrimental effect on calcium carbonate precipitation.

Where a soap is used as an additional builder it may be present in such a quantity that it will also contribute as a detergent active material.

Apart from the detergent active compounds and detergency builders, a detergent composition of the invention can contain any of the conventional additives in the amounts in which such additives are normally employed in fabric washing detergent compositions. Examples of these additives include the lather boosters such as alkanolamides, particularly the monoethanolamides derived from palm kernel fatty acids and coconut fatty acids, lather depressants, oxygen-releasing bleaching agents such as sodium perborate and sodium percarbonate, peracid bleach precursors, chlorine-releasing bleaching agents such as trichloroisocyanuric acid, fabric softening agents, inorganic salts such as sodium sulphate, and, usually present in very minor amounts, fluorescent agents, perfumes, enzymes such as proteases and amylases, germicides and colourants.

The detergent compositions of the invention may take any of the common physical forms associated with fabric washing detergent compositions, such as powders, granules, cakes and liquids. They may also be produced by any of the techniques commonly employed in the manufacture of fabric washing detergent compositions, including particularly slurry-making and spray-drying processes for the manufacture of detergent powders. The insoluble carbonate material may be incorporated in the slurry or post-dosed to a spray-dried base powder. Alternatively, where the product is spray-dried, the insoluble carbonate material may be formed in situ by reaction in the slurry between the water-soluble carbonate material and, say, calcium oxide or hydroxide. However, the fine powder form of dry calcium carbonate, when used, may necessitate steps to control dustiness.

The invention will now be illustrated by the following non-limiting examples.

EXAMPLE 1

The following formulation was prepared by dry-mixing the ingredients:

| | |
|---|---|
| Nonionic detergent active (Synperonic 7 EO) | 7.1% |
| Sodium carbonate | 21.4% |
| Sodium sulphate | 24.3% |
| Sodium perborate (measured as tetrahydrate) | 18.6% |
| Calofort U (17–23 $m^2/g$ calcite) | 14.3% |
| Polymer | 0.7% |
| Water | balance |

The formulation was used to wash clean cotton test cloths at a dosage level equivalent to 1.5 g/l sodium carbonate, at 25° C. in 24°H hard water for 30 minutes. This washing process was repeated ten times after which the level of deposition was determined by conventional washing procedures.

Where the polymer was 3:1 sulphonated styrene/maleic anhydride copolymer with a molecular weight of 34,000 the level of ash after ten washes was lower than when the polymer was a homopolymer of sulphonated styrene with a molecular weight of 500,000.

EXAMPLE 2

Similar results can be obtained with the following formulation:

| | |
|---|---|
| Spray dried base powder: | |
| Anionic detergent active (Korenyl Neu) | 9.0% |
| Sodium carbonate | 24.8% |
| Sodium sulphate | 13.9% |
| Sodium silicate | 4.5% |
| Water | balance |
| Post dosed ingredients: | |
| Calofort U | 116.5% |
| Sodium perborate | 21.0% |
| Polymer (as in Example 1) | 0.8% |

EXAMPLE 3

The formulation of Example 2 with the perborate replaced by metaborate was used to wash artificially soiled test cloths at a dosage level equivalent to 1.5 g/l sodium carbonate, at 25° C. in 24°H hard water for 15 minutes. After rinsing and drying the washed test cloths the detergency was determined by routine procedures. When the polymer was a 3:1 sulphonated styrene/maleic anhydride copolymer with a molecular weight of 34,000 (as in Example 1) the detergency was better than when the polymer was polymaleic anhydride, polyacrylic acid or sodium tripolyphosphate.

EXAMPLE 4

The following example illustrates the essential nature of the water-insoluble carbonate material in the compositions of the present invention.

The following formulations were prepared by dry mixing the ingredients:

| Example No | 4A | 4B |
|---|---|---|
| Nonionic detergent active (Synperonic 7EO) | 7.1% | 7.1% |
| Sodium carbonate | 21.4% | 21.4% |
| Sodium sulphate | 24.3% | 38.6% |
| Sodium perborate (measured as tetrahydrate) | 18.6% | 18.6% |
| Calofort U (17–23 $m^2/g$ calcite) | 14.3% | — |
| Polymer | 0.7% | 0.7% |
| Water | balance | |

These formulations were used to wash test cloths under the same conditions as in Example 1.

The polymers used were (P1) 3:1 sulphonated styrene/maleic anhydride copolymer, molecular weight 34,000, (P2) 3:1 acrylamide/acrylic acid copolymer molecular weight 101,200, (P3) as P2 with a molecular weight of 67,700 and (P4) 3:1 2-hydroxy ethyl acrylate/acrylic acid copolymer having a molecular weight of 7,900.

The results obtained were as follows:

| Polymer | % Ash after 10 washes Example No 4A | 4B |
|---|---|---|
| None[1] | 6.4 | 6.4 |
| P1 | 1.2 | 5.1 |
| P2 | 1.2 | 5.4 |
| P3 | 1.3 | 3.6 |
| P4 | 2.2 | 4.8 |

Note 1: The level of sodium sulphate was increased by 0.7%.

It can be seen from these results that in the absence of calcite (Example 4B) the addition of polymer reduces the level of ash, but not substantially. On the other hand, in the presence of calcite (Example 4A) the improvement is far more substantial.

We claim:

1. A detergent composition comprising:

(i) from 5 to 40% by weight of a detergent active material;

(ii) from 10% to 40% by weight of a water-soluble carbonate material;

(iii) from 5% to 60% of a water-insoluble carbonate material; and (iv) from 0.2% to 5% by weight of a copolymer of maleic anhydride and a monomer selected from the group consisting of sulfonated styrene and 2-acrylamido-2-methyl propane sulfonic acid, wherein the weight ratio of said monomer to said maleic anhydride is about 3:1, said copolymer having a molecular weight of between 1,000 and 500,000.

2. The detergent composition according to claim 1 wherein the monomer is sulfonated styrene.

3. The detergent composition according to claim 1 wherein the water-insoluble carbonate material is calcium carbonate.

4. The detergent composition according to claim 3, wherein the calcium carbonate has a surface area of at least $5m^2/g$.

5. The detergent composition according to claim 1 wherein the copolymer has a molecular weight of between 5,000 and 100,000.

6. The detergent composition according to claim 2 wherein the water-insoluble carbonate material is calcium carbonate.

7. The detergent composition according to claim 2 wherein the copolymer has a molecular weight of between 5,000 and 100,000.

* * * * *